US006771242B2

(12) United States Patent
Ham

(10) Patent No.: US 6,771,242 B2
(45) Date of Patent: Aug. 3, 2004

(54) METHOD AND APPARATUS FOR DRIVING LIQUID DISPLAY

(75) Inventor: Yong Sung Ham, Kyounggi-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 241 days.

(21) Appl. No.: 09/991,661

(22) Filed: Nov. 26, 2001

(65) Prior Publication Data

US 2002/0196218 A1 Dec. 26, 2002

(30) Foreign Application Priority Data

Jun. 11, 2001 (KR) ..... P2001-32410
Sep. 5, 2001 (KR) ..... P2001-54327

(51) Int. Cl.[7] ..... G09G 3/36
(52) U.S. Cl. ..... 345/89; 345/690; 348/254
(58) Field of Search ..... 345/87–89, 95, 345/204, 211, 596–602, 690–692; 348/254, 671

(56) References Cited

U.S. PATENT DOCUMENTS 4,775,891 A * 10/1988 Aoki et al. ..... 348/572
5,122,792 A * 6/1992 Stewart ..... 345/692
5,162,786 A * 11/1992 Fukuda ..... 345/100
5,363,118 A * 11/1994 Okumura ..... 345/95
5,495,265 A 2/1996 Hartman et al.
5,621,426 A * 4/1997 Okada et al. ..... 345/95
5,677,704 A * 10/1997 Kusano et al. ..... 345/89
5,808,596 A * 9/1998 Kim ..... 345/98
6,377,234 B1 * 4/2002 Nogawa ..... 345/89
2001/0038372 A1 * 11/2001 Lee ..... 345/89

FOREIGN PATENT DOCUMENTS

WO WO 99/05567 2/1999

* cited by examiner

*Primary Examiner*—Henry N. Tran
(74) *Attorney, Agent, or Firm*—Morgan Lewis & Bockius LLP

(57) ABSTRACT

The present invention discloses a method and apparatus for driving a liquid crystal display device that prevents a deterioration of picture quality. More specifically, in the method and apparatus, a determination as to whether input data should be modulated is made in accordance with the compared results of the most/least significant bit data with the first and second reference values.

27 Claims, 10 Drawing Sheets

METHOD AND APPARATUS FOR DRIVING LIQUID DISPLAY

This application claims the benefit of Korean Application Nos. P2001-32410 filed on Jun. 11, 2001 and P2001-54327 filed on Sep. 5, 2001, which are hereby incorporated by reference.

BACKGROUND OF THE INVENTION

1. Field of the Invention

The present invention relates to a liquid crystal display, and more particularly, to a method and apparatus for driving a liquid crystal display. Although the present invention is suitable for a wide scope of applications, it is particularly suitable for preventing deterioration in picture quality.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a moving picture. The active matrix LCD uses a thin film transistor (TFT) as a switching device.

The LCD has a disadvantage in that it has a slow response time due to inherent characteristics of a liquid crystal such as a viscosity and an elasticity, etc. Such characteristics can be explained by using the following equations (1) and (2):

$$\tau_r \propto \gamma d^2/\Delta\epsilon|V_a^2-V_F^2| \quad (1)$$

where $\tau_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of liquid crystal cells, and $\gamma$ represents a rotational viscosity of the liquid crystal molecules.

$$\tau_f = \gamma d^2/K \quad (2)$$

where $\tau_f$ represents a falling time at which a liquid crystal is returned into the initial position by an elastic restoring force after a voltage applied to the liquid crystal was turned off, and K is an elastic constant.

A twisted nematic (TN) mode liquid crystal has a different response time due to physical characteristics of a liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon, a moving picture is blurred out on the screen.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in data by using a look-up table (hereinafter referred to as high-speed driving scheme). This high-speed driving scheme allows data to be modulated by a principle as shown in FIG. 2.

Referring to FIG. 2, a conventional high-speed driving scheme modulates input data VD and applies the modulated data MVD to the liquid crystal cell, thereby obtaining a desired brightness MBL. In the high-speed driving scheme, $|V_a^2-V_F^2|$ is increased from the above equation (1) on the basis of a difference of the data so that a desired brightness can be obtained in response to a brightness value of the input data within one frame interval, thereby rapidly reducing a response time of the liquid crystal. Accordingly, the LCD employing such a high-speed driving scheme compensates for a slow response time of the liquid crystal by modulating the data value in order to alleviate a motion-blurring phenomenon in a moving picture, thereby displaying a picture at desired color and brightness.

Referring to FIG. 3, a conventional high-speed driving apparatus includes a frame memory 33 connected to a most significant bit output bus line 32, and a look-up table 34 connected to the most significant bit output bus line 32 and the frame memory 33.

The frame memory 33 stores most significant bit data MSB during one frame interval and supplies the stored data to the look-up table 34. Herein, the most significant bit data MSB can be set to high-order 3 or 4 bits, but may be set up to 5 or 6 bits if needed.

The look-up table 34 is a mapping of most significant bit data of a current frame Fn inputted from the most significant bit output bus line 32 and most significant bit data of the previous frame Fn−1 inputted from the frame memory 33 into a modulation data table as shown in Table 1, thereby outputting modulated data Mdata. Such modulated most significant bit data Mdata are added to non-modulated least significant bit data.

When the most significant bit data MSB are limited to 4 bits, a look-up table in the high-speed driving scheme is implemented by the following tables:

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |

TABLE 1-continued

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In the above tables, a furthermost left column is for a data voltage VDn−1 of the previous frame Fn−1 while an uppermost row is for a data voltage VDn of the current frame Fn. Table 1 is look-up table information in which the most significant bits (i.e., $2^0$, $2^1$, $2^2$ and $2^3$) are expressed by the decimal number at. Table 2 is look-up table information in which weighting values (i.e., $2^4$ $2^5$, $2^6$ and $2^7$) of the most significant 4 bits are applied to 8-bit data.

If the most significant bit data MSB are configured by 4 bits and the most significant bit data MSB of the previous frame Fn−1 and the most significant bit data MSB of the current frame Fn are given as shown in FIG. 4, the data Mdata modulated by the look-up table 34 become larger than the most significant bit data MSB of the current frame Fn.

However, the conventional high-speed driving apparatus has a problem in that data values of the modulated data Mdata become excessively larger than a real change amount of the data even when data values of the previous frame Fn−1 and the current frame Fn are slightly changed.

Referring to FIG. 5, a data gray level value '00011111' of the previous frame Fn−1 is changed into '00100000' at the current frame Fn. If a modulation is made by a modulation table such as Table 1 for a high-speed driving scheme, values of the most significant bit data are increased to '00110000'. In this process, a real gray level value difference between the previous frame Fn−1 and the current frame Fn is only the decimal number '1'. In other words, a gray level value '31' of the previous frame Fn−1 is slightly changed into '32' at the current frame Fn. However, a value modulated by the modulation table using Table 1 becomes '48'. Thus, a picture having gray levels with a slight change becomes to have a gray level difference of '17' due to the data modulation in the conventional high-speed driving scheme.

If a modulation is made with a value largely different from a real gray level value, an undesirably excessive voltage is applied to the liquid crystal cell. Thus, an unnecessary bright stripe is emerged from the boundary portion where the data is changed.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display that is adaptive for preventing a deterioration of picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes dividing input data into most significant bit data and least significant bit data, detecting changes in the most significant bit data and the least significant bit data, comparing the change in the most significant bit data with a first reference value, comparing the change in the least significant bit data with a second reference value, and determining whether input data are modulated in accordance with the compared results.

In the method, the detecting changes includes delaying the most significant bit data and the least significant bit data for a frame period, calculating a first difference between non-delayed most significant bit data and the delayed most significant bit data, and calculating a second difference between non-delayed least significant bit data and the delayed least significant bit data.

In another aspect of the present invention, a method of driving a liquid crystal display includes dividing input data from an input line into most significant bit data and least significant bit data, detecting changes in the number of bits in the most significant bit data and the least significant bit data between current and previous frames, comparing the change in the number of bits of the most significant bit data with a first reference value, comparing the change in the least significant bit data with a second reference value, modulating the input data if the change in the most significant bit data is equal to the first reference value and the change in the least significant bit data is smaller than the second reference value, and supplying the input data without a modulation if the change in the most significant bit data is equal to the first reference value and the change in the least significant bit data is equal to or larger than the second reference value.

The method further includes modulating the input data if the change in the most significant bit data is different from the first reference value.

In another aspect of the present invention, a method of driving a liquid crystal display includes dividing input data from an input line into most significant bit data and least significant bit data, determining whether current most significant bit data are included in a first data area of a look-up table, comparing a first difference value in the number of bits between current least significant bit data and previous least significant bit data with a first reference value if the current most significant bit data are included in the first data area of the look-up table, determining whether the current most significant bit data are to be modulated in accordance with the compared result of the first difference value, determining whether the current most significant bit data are included in a second data area of a look-up table, comparing a second difference value in the number of bits between the current input least significant bit data and the previous least significant bit data with a second reference value if the current most significant bit data are included in the second data area of the look-up table, and determining whether the current most significant bit data are to be modulated in accordance with the compared result of the second difference value.

In the method, the determining whether current most significant bit data are included in a first data area of a look-up table includes subtracting the current most significant bit data from the previous most significant bit data if the number of bits of the current most significant bit is greater than that of the previous most significant bit data, and determining whether a value obtained by subtracting the current most significant bit data from the previous most significant bit data is '1'.

In the method, determining whether current most significant bit data are included in a first data area of a look-up table includes subtracting the previous most significant bit data from the current most significant bit data if the number of bits of the previous most significant bit data is greater than that of the current most significant bit data, and determining whether a value obtained by subtracting the previous most significant bit data from the current most significant bit data is '1'.

In the method, the current most significant bit data are modulated if a subtracted value between the previous least significant bit data and the current least significant bit data is different from the first reference value.

In the method, the first reference value is '1' and the second reference value is a minimum recognizable gray level change by an observer.

In the method, the current most significant bit data are not modulated if a first subtracted value between the previous most significant bit data and the current most significant bit data is the same as the first reference value and if a second subtracted value between the previous least significant bit data and the current least significant bit data is greater than the second reference value.

In another aspect of the present invention, an apparatus for driving a liquid crystal display includes a frame memory delaying each of most significant bit data and least significant bit data included in input data from an input line, a first comparator comparing the most significant bit data from the input line with the delayed most significant bit data to obtain a first difference amount in the number of bits in the most significant bit data and comparing the first difference amount with a first reference value, a second comparator comparing the least significant bit data from the input line with the delayed least significant bit data to obtain a second difference amount in the number of bits in the least significant bit and comparing the second difference amount with a second reference value, and a selector determining whether the most significant bit data from the input line is to be modulated in accordance with the compared results of the first and second comparators.

In another aspect of the present invention, an apparatus for driving a liquid crystal display includes a frame memory delaying each of most significant bit data and least significant bit data included in input data from an input line, a first comparator comparing the most significant bit data from the input line with the delayed most significant bit data to obtain a first difference amount in the number of bits in the most significant bit data and comparing the first difference amount with a first reference value, a second comparator comparing the least significant bit data from the input line with the delayed least significant bit data to obtain a second difference amount in the number of bits in the least significant bit data and comparing the second difference amount with a second reference value, a modulator modulating the input data, and a selector selecting one of the modulated data and the input data from the input line in accordance with the compared results of the first and second comparators.

In the apparatus, the first reference value is '1' and the second reference value is a minimum recognizable gray level change by an observer.

The modulator modulates the most significant bit data using a look-up table.

In the apparatus, the selector selects the modulated input data if the first difference amount is equal to the first reference value and the second amount is smaller than the second reference value.

The selector selects the modulated data if the first difference amount is different from the first reference value.

The selector selects the input data from the input line if the first difference amount is equal to the first reference value and the second difference amount is larger than the second reference value.

The selector includes a gate device performing a logical operation of output signals of the first and second comparators, and a switching device selecting one of an output of the modulator and the input data from the input line in accordance with an output of the gate device.

The driving apparatus further includes a data driver supplying the modulated data and the input data from the input line to a liquid crystal display, a gate driver applying a scanning signal to the liquid crystal display, and a timing controller applying the input data to the input line and controlling the data driver and the gate driver.

In a further aspect of the present invention, an apparatus for driving a liquid crystal display includes a frame memory delaying each of most significant bit data and least significant bit data included in input data from an input line, a first comparator subtracting the most significant bit data from the input line from the delayed most significant bit data and comparing the subtracted value with a first reference value, a second comparator subtracting the delayed least significant bit data from the least significant bit data from the input line and comparing the subtracted value with a second reference value, a first logic device determining whether the most significant bit data inputted from the input line are modulated in accordance with the compared results of the first and second comparators, a third comparator subtracting the delayed most significant bit data from the most significant bit data from the input line and comparing the subtracted value with the first reference value, a fourth comparator subtracting the least significant bit data from the input line from the delayed least significant bit data and comparing the subtracted value with the second reference value, a second logic device determining whether the most significant bit data inputted from the input line is modulated in accordance with the compared results of the third and fourth comparators, a modulator modulating the most significant bit data from the input line in accordance with a change between the most significant bit data inputted from the input line and the delayed most significant bit data, and a selector selecting one of the modulated data and the input data from the input line in accordance with output logical values of the first and second logic devices.

In the driving apparatus, each of the first and second logic devices is an AND gate.

The selector includes an OR gate performing a logical sum operation of the output signals of the first and second logic devices, and a switching device selecting one of an output of the modulator and the input data from the input line under control of the OR gate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Figure 1:
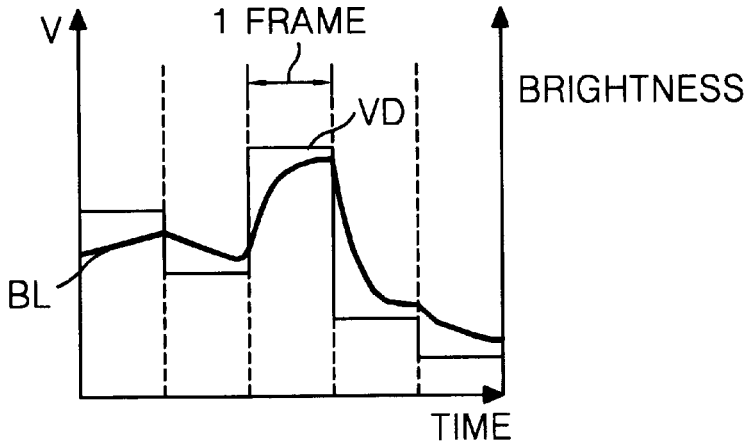
FIG. 1 CONVENTIONAL ART
FIG. 1 is a waveform diagram showing a brightness variation with respect to an applied data voltage according to a conventional liquid crystal display.
Figure 2:
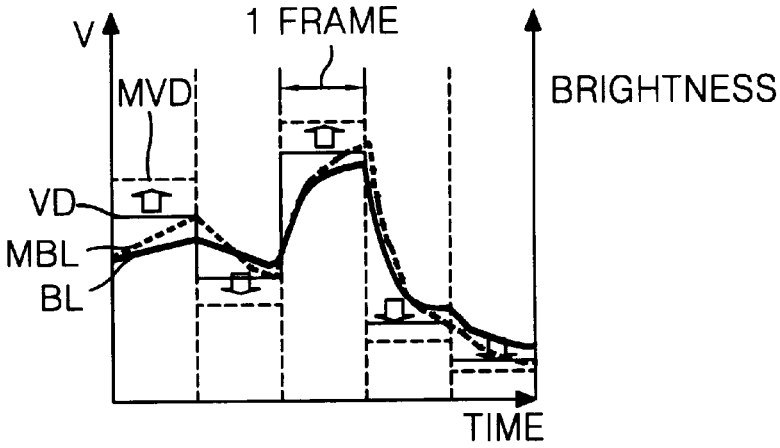
FIG. 2 CONVENTIONAL ART
FIG. 2 is a waveform diagram showing a brightness variation with respect to an applied modulated data voltage according to a conventional high-speed driving scheme.
Figure 3:
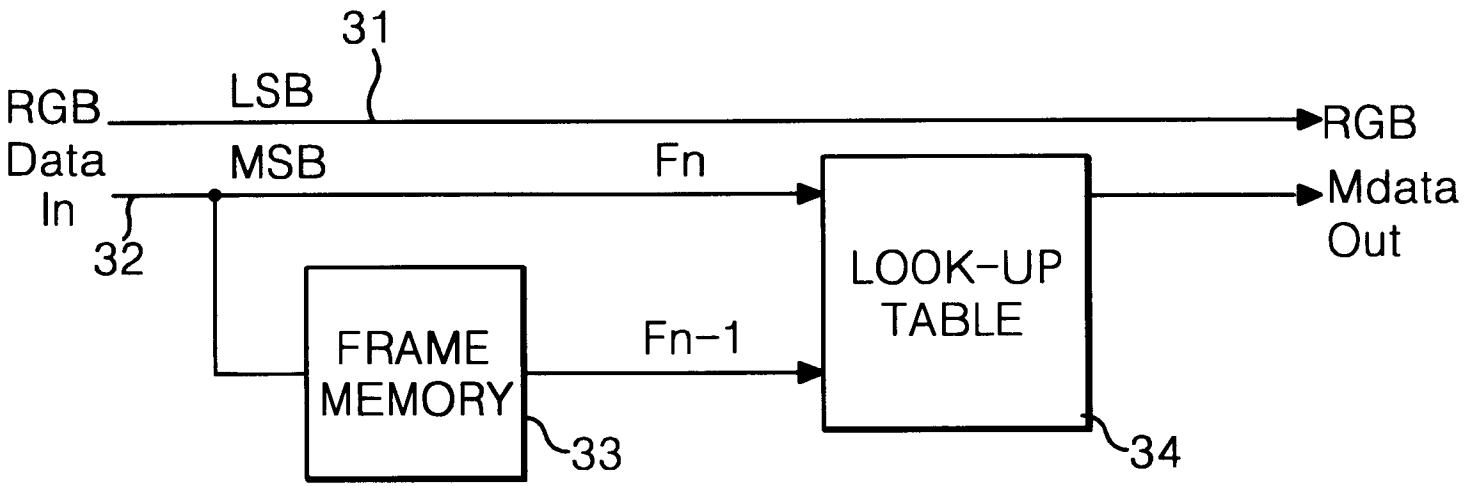
FIG.3 CONVENTIONAL ART
FIG. 3 is a block diagram showing a configuration of a conventional high-speed driving apparatus.
Figure 4:
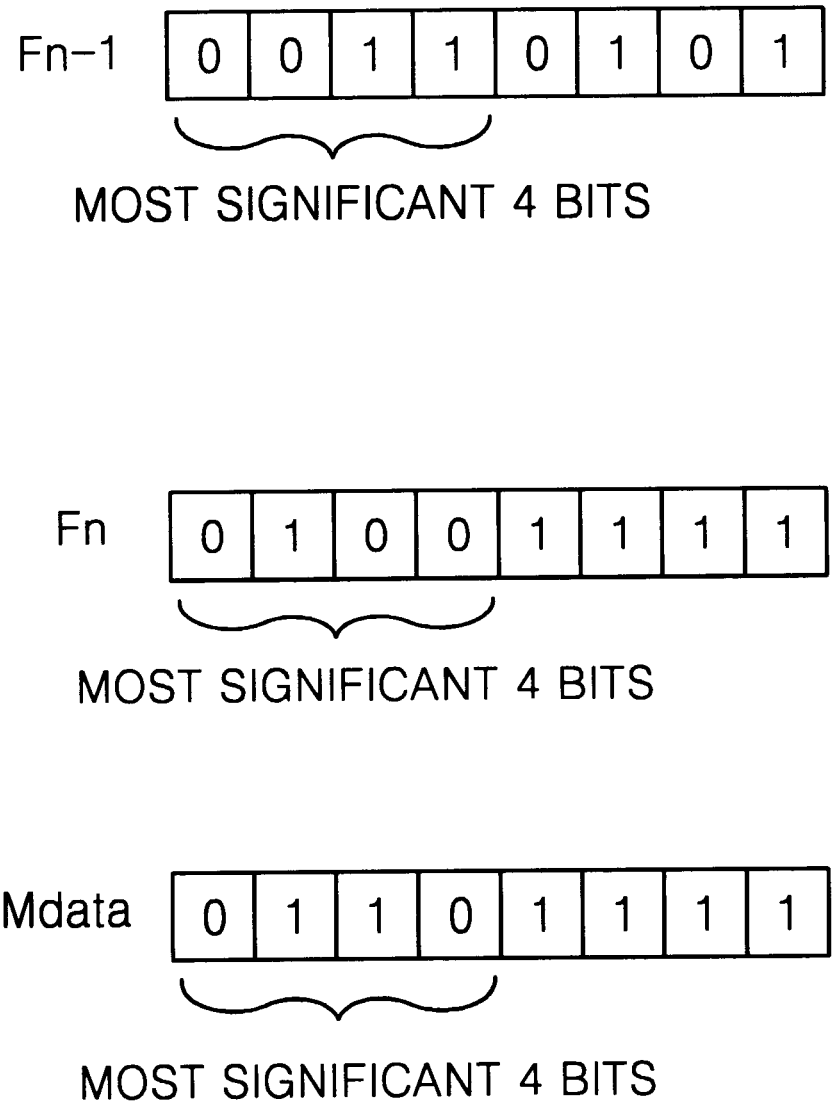
FIG. 4 CONVENTIONAL ART
FIG. 4 illustrates a modulation of most significant bit data in the conventional high-speed driving apparatus.
Figure 5:
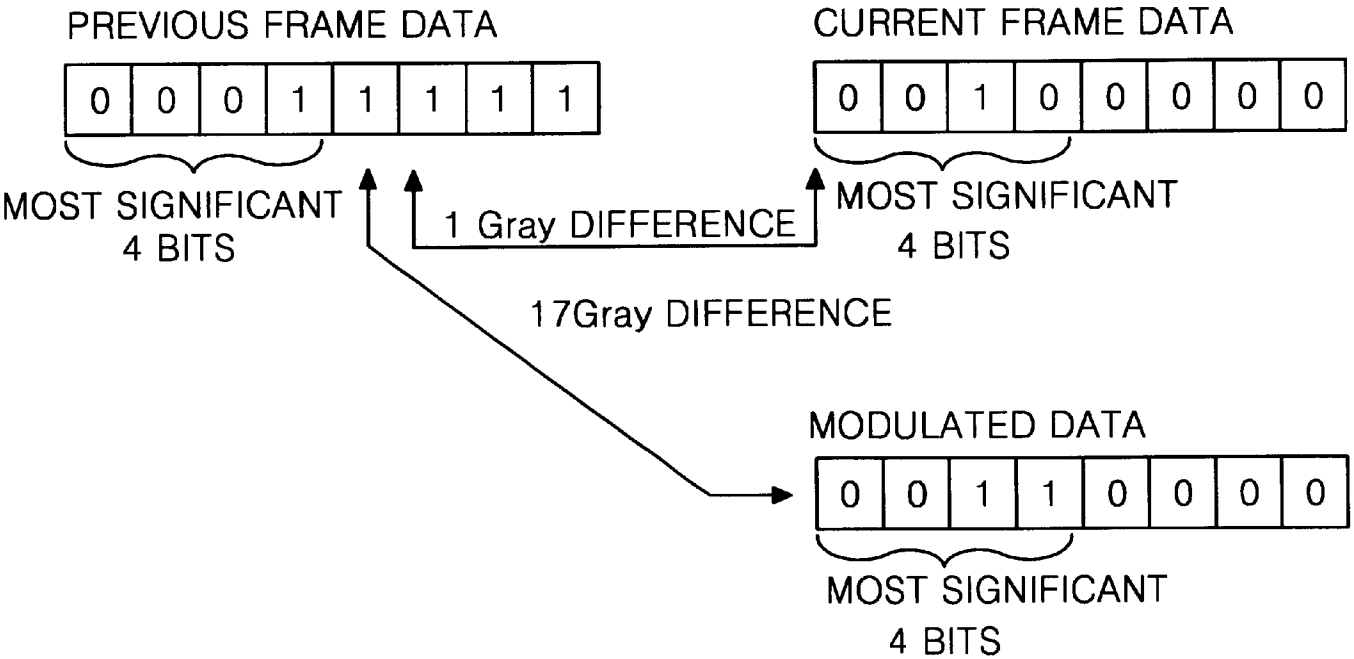
FIG.5 CONVENTIONAL ART
FIG. 5 illustrates an excessive data modulation in the conventional high-speed driving apparatus.

Reference will now be made in detail to the illustrated embodiments of the present invention, examples of which are illustrated in the accompanying drawings. Wherever possible, the same reference numbers will be used throughout the drawings to refer to the same or like parts.

An apparatus for driving a liquid crystal display (LCD) according to the present invention will be explained with reference to FIG. 6.

The LCD driving apparatus includes a liquid crystal display panel 67 having a plurality of data lines 65 and gate lines 66 crossing each other and having TFT's provided at the intersections therebetween to drive liquid crystal cells Clc. A data driver 63 supplies a data to the data lines 65 of the liquid crystal display panel 67. A gate driver 64 applies a scanning pulse to the gate lines 66 of the liquid crystal display panel 67. A timing controller 61 receives digital video data and horizontal and vertical synchronizing signals H and V. A data modulator 62 is connected between the timing controller 61 and the data driver 63 to modulate input data RGB.

More specifically, the liquid crystal display panel 67 has a liquid crystal formed between two glass substrates, and has the data lines 65 and the gate lines 66 provided on the lower glass substrate in such a manner to perpendicularly cross each other. The TFT provided at each intersection between the data lines 65 and the gate lines 66 responds to the scanning pulse to the data through the data lines 65 to the liquid crystal cell Clc. To this end, a gate electrode of the TFT is connected to the gate lines 66 while a source electrode thereof is connected to the data lines 65. The drain electrode of the TFT is connected to a pixel electrode of the liquid crystal cell Clc.

The timing controller 61 rearranges the digital video data supplied from a digital video card (not shown). The RGB data rearranged by the timing controller 61 is supplied to the data modulator 62. Further, the timing controller 61 generates timing signals, such as a dot clock Dclk, a gate start pulse GSP, a gate shift clock GSC (not shown), an output enable/disable signal, and a polarity control signal using horizontal and vertical synchronizing signals H and V to control the data driver 63 and the gate driver 64. The dot clock Dclk and the polarity control signal are applied to the data driver 63 while the gate start pulse GSP and the gate shift clock GSC are applied to the gate driver 64.

The gate driver 64 includes a shift register sequentially generating a scanning pulse, that is, a gate high pulse, in response to the gate start pulse GSP and the gate shift clock GSC applied from the timing controller 61, and a level shifter shifting a voltage of the scanning pulse into a level suitable for driving the liquid crystal cell Clc. The TFT is turned on in response to the scanning pulse to apply video data through the data lines 65 to the pixel electrode of the liquid crystal cell Clc.

The data driver 63 is supplied with red (R), green (G), and blue (B) modulated data RGB Mdata modulated by the data modulator 62 and receives the dot clock Dclk from the timing controller 61. The data driver 63 latches the red (R), green (G), and blue (B) modulated data RGB Mdata in synchronization with the dot clock Dclk and thereafter converts the latched data into analog data to apply through the data lines 65 line by line. Further, the data driver 63 may apply a gamma voltage corresponding to the modulated data to the data line 65.

The data modulator 62 compares the most significant bit data MSB and the least significant bit data LSB at each of the previous frame Fn−1 and the current frame Fn to detect a gray level change of the input data. The data modulator 62 determines a modulation of the data in accordance with a magnitude of the detected gray level change.

Figure 7:
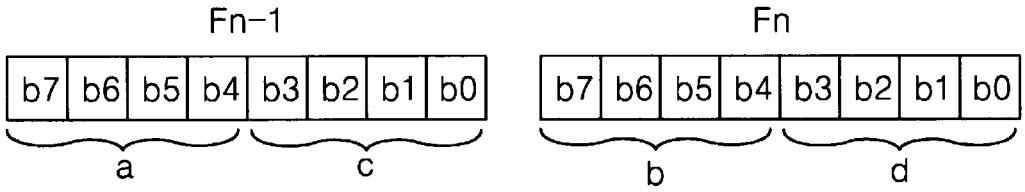
FIG. 7 illustrates data inputted to the data modulator of FIG. 6.

The RGB data inputted to the data modulator 62 has an expressible gray level range of 0 to 255 and has 8 bits as shown in FIG. 7. A modulation algorithm of the data modulator 62 will be described in conjunction with FIG. 8.

At each of the previous frame Fn−1 and the current Frame Fn, the most significant bit data MSB are 4 bits of b4 to b7 and the least significant bit data LSB are 4 bits of b0 to b3. The most significant bit data MSB of the previous frame Fn−1 are 'a' while the least significant bit data LSB thereof are 'c'. The most significant bit data MSB of the current frame Fn are 'b' while the least significant bit data LSB are 'd'.

Figure 8:
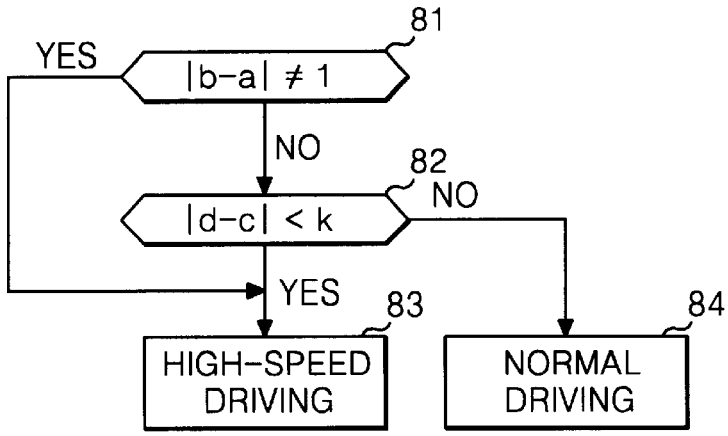
FIG. 8 is a flow chart illustrating a control procedure of the data modulator according to a first embodiment of the present invention.

FIG. 8 shows a control procedure of the data modulator according to a first embodiment of the present invention.

Referring to FIG. 8, the data modulator 62 (shown in FIG. 6) detects a difference in the number of bits between the most significant data 'b' and 'a', that is, a gray level change (i.e., $|b-a|$) from the current frame Fn and the previous frame Fn−1. Also, the data modulator 62 detects a difference in the number of bits between the least significant data 'd' and 'c' (i.e., $|d-c|$) from the current frame Fn and the previous frame Fn−1.

In step 81, the data modulator 62 determines a data value change of the most significant bit data 'b' and 'a' from the current frame Fn and the previous frame Fn−1. If the most significant bit data 'a' and 'b' are not changed in the data value (i.e., $b-a=0$) or the number of changing bits is more than two (i.e., $|b-a|>1$) the data modulator 62 performs step 83 to modulate the data using a look-up table such as Table 1.

Otherwise, if the bit number of the most significant bit data 'a' and 'b' having a data value change is one (i.e., $|b-a|=1$ at step 81) the data modulator 62 determines the number of bits in which data values of the least significant bit data 'd' and 'c' are changed from the current frame Fn and the previous frame Fn−1 at step 82. If a difference in the gray level value between the least bit data 'd' and 'c' at the current frame Fn and the previous frame Fn−1 is smaller than a desired reference value 'k', the data modulator 62 modulates the input data using the look-up table at step 83. Otherwise, if a difference in the gray level value between the less bit data 'd' and 'c' at the current frame Fn and the previous frame Fn−1 is larger than a desired reference value 'k', the data modulator 62 does not modulate the input RGB data and performs the procedure at step 84. Herein, 'k' is a minimum recognizable gray level change between frames by an observer. For example, 'k' may be '12' in consideration of the bit number of the least significant bit data LSB. Such a reference value 'k' of the least significant bit data 'c' and 'd' may be changed depending on the bit number of the least significant bit data 'c' and 'd' and a visual recognition characteristic by an observer.

As a result, the data modulator 62 carries out a data modulation using a gray level value change of the least significant bit data LSB when the number of bits changing at the most significant bit data 'a' and 'b' is larger than '1'. Also, the data modulator 62 carries out a data modulation when the number of bits changing at the most significant bit data 'a' and 'b' is '1' and when the number of bits changing at the least significant bit data 'c' and 'd' is smaller than the desired reference value 'k'. On the other hand, the data modulator 62 bypasses the input data into the data driver 32 without a data modulation when the number of bits changing at the most significant bit data 'a' and 'b' is '1' and when the number of bits changing at the least significant bit data 'c' and 'd' is larger than the desired reference value 'k'.

Figure 9:
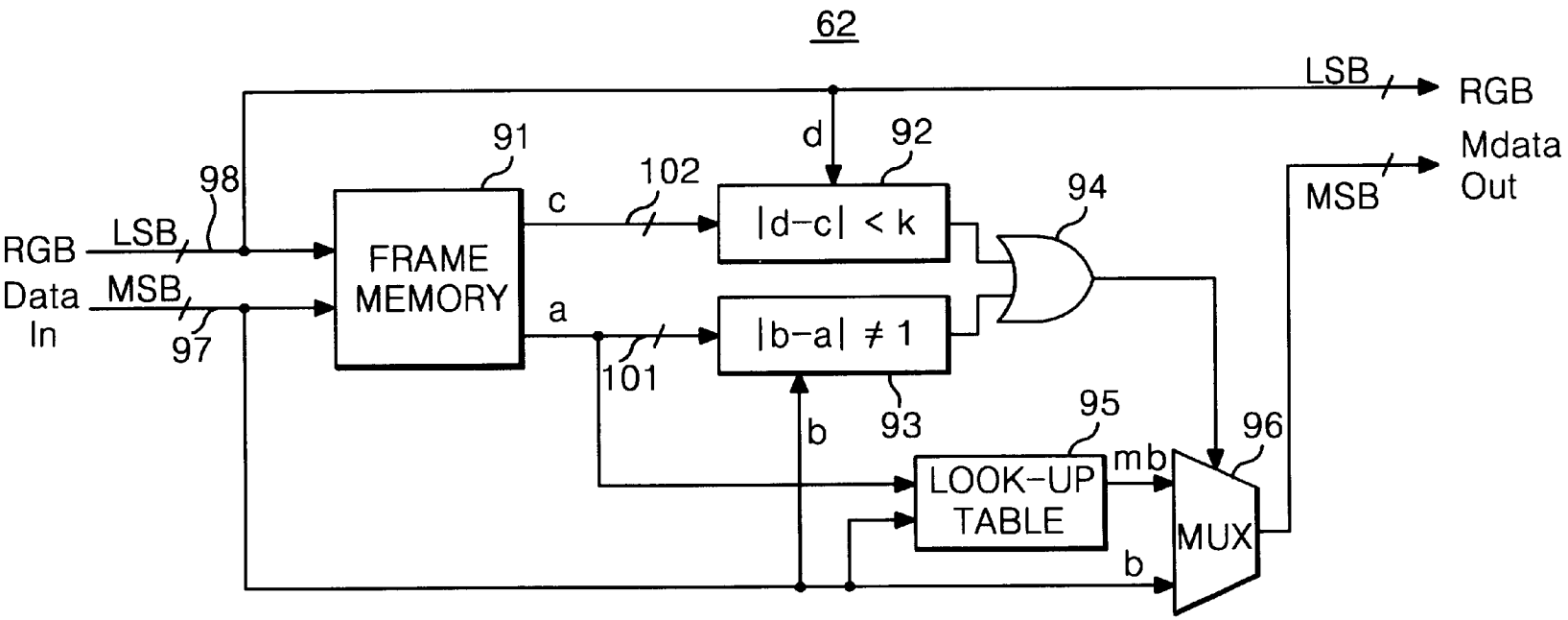
FIG. 9 is a detailed block diagram of the data modulator according to the first embodiment of the present invention.

Referring to FIG. 9, a data modulator 62 according to a first embodiment of the present invention includes a frame memory 91 receiving RGB data from the timing controller 61. A look-up table 95 modulates the most significant bit data MSB. A multiplexor (MUX) 96 selects one of modulated most significant bit data mb and non-modulated most significant bit data 'b'. A first comparator 92, a second comparator 93, and an OR gate 94 are connected between the frame memory 91 and the MUX 96.

More specifically, the frame memory 91 is connected to a most significant bit output bus line 97 and a least significant bit output bus line 98 of the timing controller 61 to store the most significant bit data MSB and the least significant bit data LSB inputted from the timing controller 61 during one frame interval. The frame memory 91 supplies the stored most significant bit data MSB to the look-up table 95 and the second comparator 93 and supplies the least significant bit data LSB to the first comparator 92 every frame.

The look-up table 95 modulates the most significant bit data MSB of the current frame Fn by using the following equations in accordance with a change between the most significant bit data 'b' of the current frame Fn inputted from the most significant bit bus output line 97 of the timing controller 61 and the most significant bit data 'a' of the previous frame Fn−1 inputted from a most significant bit bus output line 101 of the frame memory 91.

$$VDn<VDn-1 \rightarrow MVDn<VDn \quad \text{(i)}$$

$$VDn<VDn-1 \rightarrow MVDn=VDn \quad \text{(ii)}$$

$$VDn>VDn-1 \rightarrow MVDn>VDn \quad \text{(iii)}$$

In the above equations, VDn−1 represents a data voltage of the previous frame, VDn is a data voltage of the current frame, and MVDn represents a modulated data voltage.

The first comparator 92 calculates a difference value between the least significant bit data 'd' of the current frame Fn inputted from the least significant bit bus output line 98 of the timing controller 61 and the least significant bit data 'c' of the previous frame Fn−1 inputted from a least significant bit output bus line 102 of the frame memory 91. Further, the first comparator 92 compares a difference between the least significant bit data 'c' and 'd' of the previous frame Fn−1 and the current frame Fn with the reference value 'k'. If a difference value between the least significant bit data 'c' and 'd' of the previous frame Fn−1 and the current frame Fn is less than the reference value 'k', the first comparator 92 applies high logic '1' to a first input terminal of the OR gate 94. Otherwise, if a difference value between the least significant bit data 'c' and 'd' of the previous frame Fn−1 and the current frame Fn is larger than the reference value 'k', the first comparator 92 applies low logic '0' to the first input terminal of the OR gate 94.

The second comparator 93 calculates a difference value between the most significant bit data 'b' of the current frame Fn inputted from the most significant bit output bus line 97 of the timing controller 61 and the most significant bit data 'a' of the previous frame Fn−1 inputted from the most significant bit output bus line 101 of the frame memory 91. Further, the second comparator 93 compares a difference between the most significant bit data 'a' and 'b' of the previous frame Fn−1 and the current frame Fn with '1'. If a difference value between the most significant bit data 'a' and 'b' of the previous frame Fn−1 and the current frame Fn is not '1', the second comparator 93 applies high logic '1' to a second input terminal of the OR gate 94. Otherwise, if a difference value between the most significant bit data 'a' and 'b' of the previous frame Fn−1 and the current frame Fn is '1', the second comparator 93 applies low logic '0' to the second input terminal of the OR gate 94.

The OR gate 94 is connected between the MUX 96 and the first and second comparators 92 and 93 to perform a logical sum operation of output signals of the first and second comparators 92 and 93 and control the MUX 96 in accordance with the resultant value. When a difference value of the most significant data 'a' and 'b' after the logical sum operation is not '1', the OR gate 94 outputs high logic '1'. Otherwise, when a difference value of the most significant value 'a' and 'b' is '1', the OR gate 94 selects high logic '1' or low logic '0' depending on a change amount of the least significant bit data 'c' and 'd'. If a difference value of the most significant bit data 'a' and 'b' is '1' and a difference value of the least significant bit data 'c' and 'd' is less than the reference value 'k', the OR gate 94 outputs high logic '1'. On the other hand, if a difference value of the most significant bit data 'a' and 'b' is '1' and a difference value of the least significant bit data 'c' and 'd' is larger than the reference value 'k', the OR gate 94 outputs low logic '0'.

The MUX 96 is supplied with the most significant bit data mb modulated by the look-up table 95 and the most significant bit data inputted via the most significant bit output bus line 97 of the timing controller 61, that is, the non-modulated most significant bit data b. The MUX 96 is controlled by an output signal of the OR gate 94 to select one of the modulated most significant bit data mb and the non-modulated most significant bit data 'b'. If an output signal of the OR gate 94 has high logic '1', the MUX 96 outputs the most significant bit data mb modulated by the look-up table 95. If an output signal of the OR gate 94 has low logic '0', the MUX 96 outputs the non-modulated most significant bit data 'b'. Accordingly, when a difference value of the most significant bit data 'a' and 'b' is not '1' or when the above-mentioned difference value is '1' and a difference value of the least significant bit data 'c' and 'd' is less than the reference value 'k', the MUX 96 outputs the modulated most significant bit data mb. On the other hand, when a difference value of the most significant bit data 'a' and 'b' is '1' and a difference value of the least significant bit data 'c' and 'd' is larger than the reference value 'k', the MUX 96 outputs the non-modulated most significant bit data 'b'.

The most significant bit data mb or 'b' and the least significant bit data 'd' outputted from the data modulator 62 are combined with each other and then applied to the data driver 63.

Figure 10:
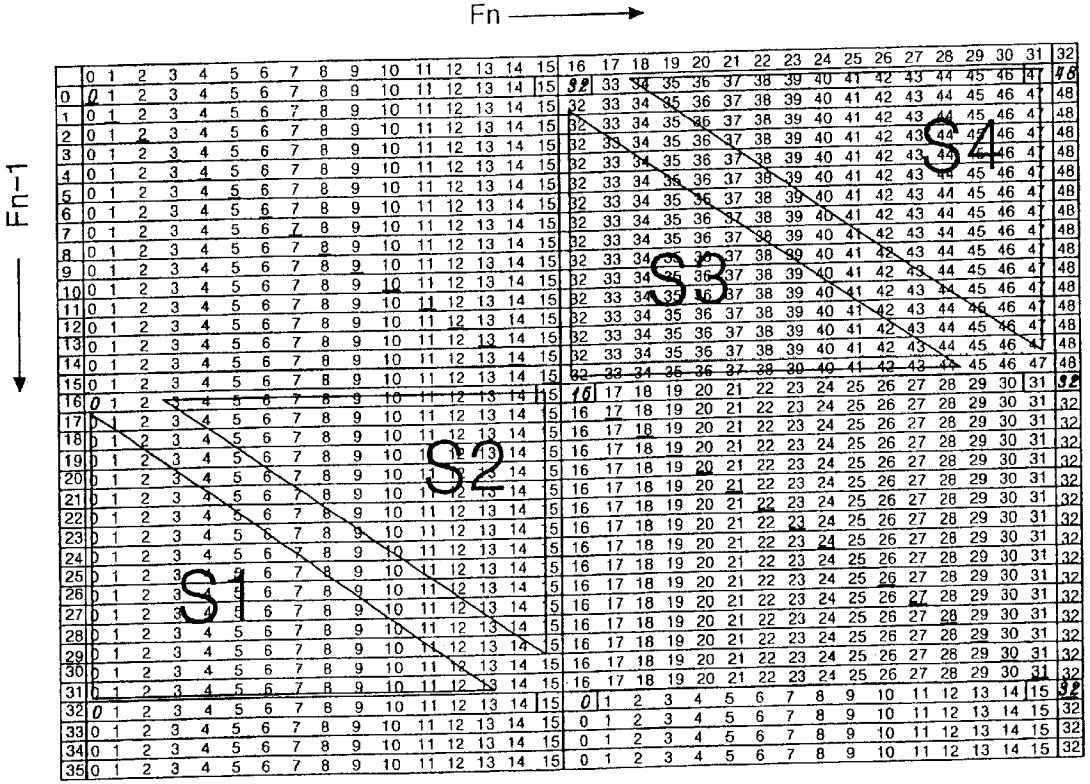
FIG. 10 illustrates a modulating data area and a non-modulating data area of a look-up table in a liquid crystal display driving apparatus and method according to the present invention.

Since a data modulation and a data bypass are selected on the basis of a real data change amount as mentioned above, the look-up table may be classified into a modulating data area and a non-modulating data area as shown in FIG. 10 depending on the real data change amount. In order to display a picture at a natural gray level, data included in the first and fourth data area S1 and S4 in FIG. 10 should be modulated on the basis of the above equations (i) to (iii) while the second and third data areas S2 and S3 should be bypassed without a modulation process. Accordingly, a process for selecting the modulating data area or the non-modulating data area is required.

Figure 11:
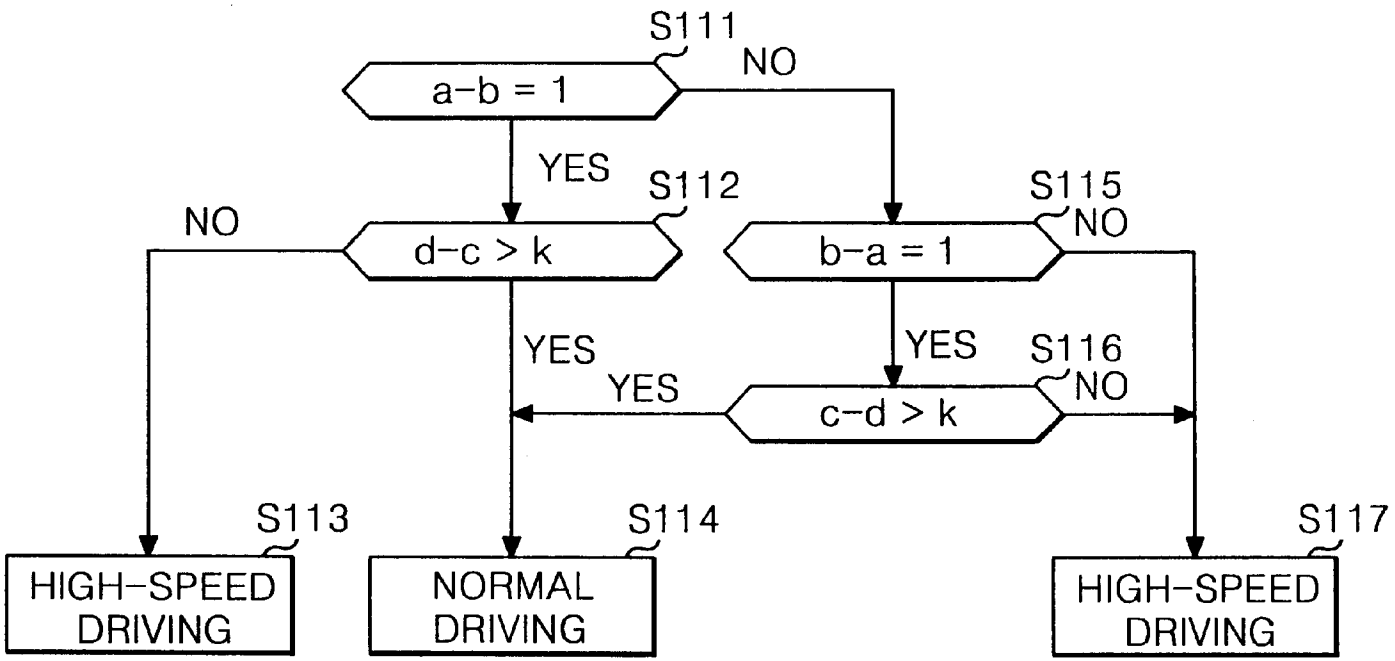
FIG. 11 is a flow chart illustrating a control procedure of the data modulator according to a second embodiment of the present invention.

FIG. 11 shows a control procedure of the data modulator 62 according to a second embodiment of the present invention.

Hereinafter, such a control procedure of the data modulator will be described in conjunction with the look-up table of FIG. 10.

Referring to FIG. 11, the data modulator 62 (shown in FIG. 6) subtracts the most significant bit data 'b' of the current frame Fn from the most significant bit data 'a' of the previous frame Fn−1. Subsequently, the data modulator 62 determines whether a value obtained by subtracting the most significant bit data 'b' of the current frame Fn from the most significant bit data 'a' of the previous frame Fn−1 is '1' at step S111.

If a value obtained by subtracting the most significant bit data 'b' of the current frame Fn from the most significant bit data 'a' of the previous frame Fn−1 is '1' at step S111, the data modulator 62 determines whether a value obtained by subtracting the least significant bit data 'c' of the previous frame Fn−1 from the least significant bit data 'd' of the current frame Fn is larger than the reference value 'k' at step S112. In other words, if it is determined that current input data are included in the first and second data areas S1 and S2 at which data inputted at the current frame Fn are smaller than data inputted at the previous frame Fn−1 at step S111, the data modulator 62 performs step S112.

If it is determined that a value obtained by subtracting the least significant bit data 'c' of the previous frame Fn−1 from the least significant bit data 'd' of the current frame Fn is less than the reference value 'k' at step S112, the data modulator 62 modulates the current input data using the look-up table at step S113. In other words, step S112 determines whether the current input data are included in the first data area S1 of the look-up table at which the data inputted at the current frame Fn are smaller than the data inputted at the previous frame Fn−1. Also, it determines whether a value obtained by subtracting the least significant bit data 'c' of the previous frame Fn−1 from the least significant bit data 'd' of the current frame Fn is less than the reference value 'k'.

If it is determined that a value obtained by subtracting the least significant bit data 'c' of the previous frame Fn−1 from the least significant bit data 'd' of the current frame Fn is larger than the reference value 'k' at step S112, the data modulator 62 bypasses the current input data into the output line without a modulation using the look-up table at step S114. In other words, if the current input data are included in the second area S2 at which the data inputted at the current frame Fn are smaller than the data inputted at the previous frame Fn−1 and are larger than the reference value 'k' at step S112, the data modulator 62 bypasses the current input data.

If a value obtained by subtracting the most significant bit data 'b' of the current frame Fn from the most significant bit data 'a' of the previous frame Fn−1 is not '1', that is, if the current input data are not smaller than the data at the previous frame Fn−1, the data modulator 62 performs step S115. At step 115, the data modulator 62 subtracts the most significant bit data 'a' of the previous frame Fn−1 from the most significant bit data 'b' of the current frame Fn. Subsequently, the data modulator 62 determines whether a value obtained by subtracting the most significant bit data 'a' of the previous frame Fn−1 from the most significant bit data 'b' of the current frame Fn is '1'.

If a value obtained by subtracting the most significant bit data 'a' of the previous frame Fn−1 from the most significant bit data 'b' of the current frame Fn is '1' at step S115, the data modulator 62 determines whether a value obtained by subtracting the least significant bit data 'd' of the current frame Fn from the least significant bit data 'c' of the previous frame Fn−1 is larger than the reference value 'k' at step S116. In other words, if it is determined that the current input data are included in the third and fourth data areas S3 and S4 at which the data inputted at the current frame Fn are larger than the data inputted at the previous frame Fn−1 at the step S115, the data modulator 62 performs step S116.

If a value obtained by subtracting the most significant bit data 'a' of the previous frame Fn−1 from the most significant bit data 'b' of the current frame Fn is not '1' at step S115, the data modulator 62 performs step S117.

If it is determined that a value obtained by subtracting the least significant bit data 'd' of the current frame Fn from the least significant bit data 'c' of the previous frame Fn−1 is larger than the reference value 'k' at step S116, the data modulator 62 bypasses the current input data to the output line without a modulation using the look-up table at step S114. In other words, step S116 determines whether the current input data are included in the third data area S3 of the look-up table at which the data inputted at the current frame Fn are larger than the data inputted at the previous frame Fn−1 and are larger than the reference value 'k'.

If it is determined that a value obtained by subtracting the least significant bit data 'd' of the current frame Fn from the least significant bit data 'c' of the previous frame Fn−1 is less than the reference value 'k' at step S116, the data modulator 62 modulates the current input data using the look-up table at step 117. In other words, if the current input data are included in the fourth area S4 at which the data inputted at the current frame Fn are larger than the data inputted at the previous frame Fn−1 and are less than the reference value 'k' at step S116, the data modulator 62 modulates the current input data.

Figure 12:
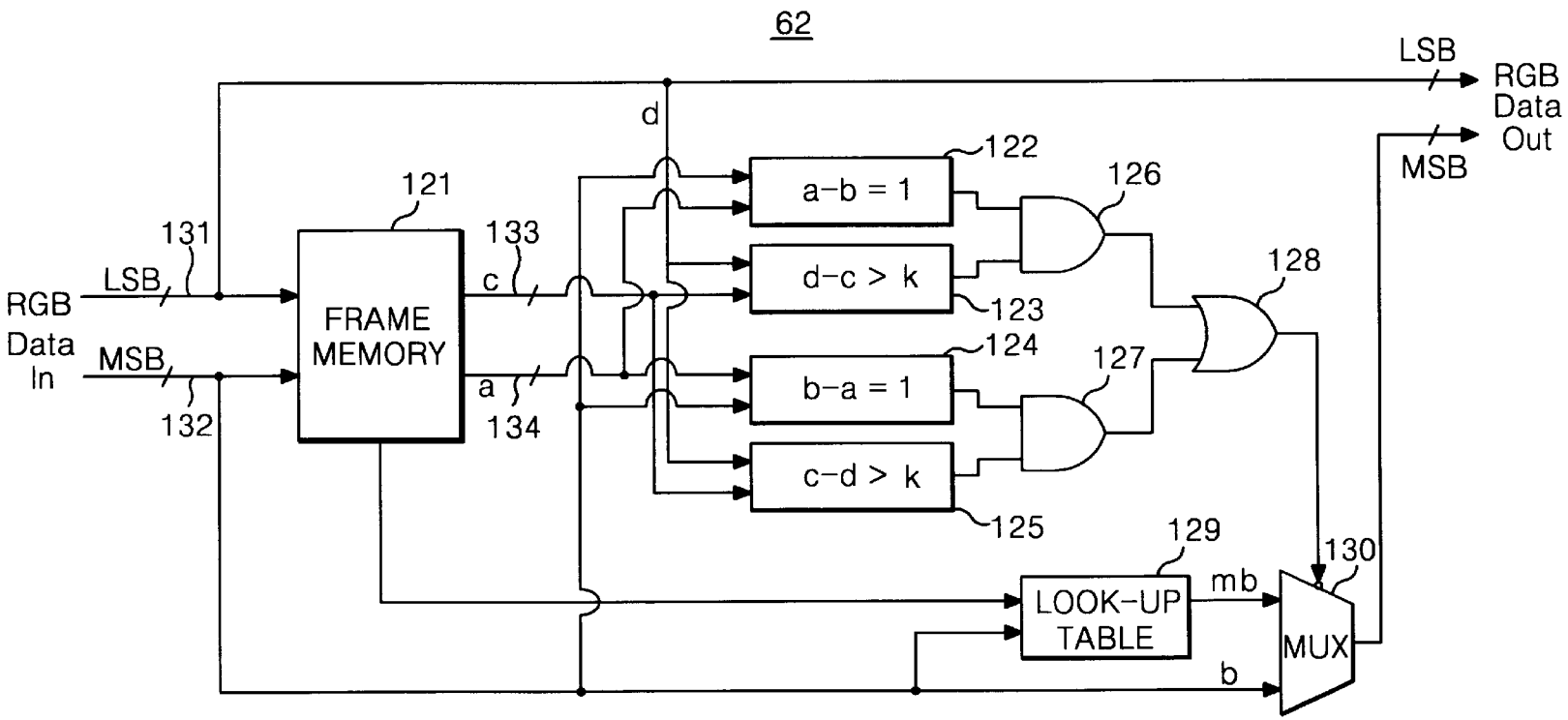
FIG. 12 is a detailed block diagram of the data modulator according to the second embodiment of the present invention.

Referring to FIG. 12, the data modulator 62 according to a second embodiment of the present invention includes a frame memory 121 receiving RGB data from the timing controller 61. A look-up table 129 modulates the most significant bit data MSB. A multiplexor (MUX) 130 selects one of modulated most significant bit data mb and non-modulated most significant bit data 'b'. First to fourth comparators 122 to 125, first and second AND gates 126 and 127, and an OR gate 128 are connected between the frame memory 121 and the MUX 130.

More specifically, the frame memory 121 is connected to a most significant bit output bus line 132 and a least significant bit output bus line 131 of the timing controller 61 to store the most significant bit data MSB and the least significant bit data LSB inputted from the timing controller 61 during one frame interval. Further, the frame memory 12 supplies the stored most significant bit data MSB to the look-up table 129 and the first and third comparators 122 and 124, and supplies the least significant bit data LSB to the second and fourth comparators 123 and 125 every frame.

The look-up table 129 modulates the most significant bit data MSB of the current frame Fn by using the above equations in accordance with a change between the most significant bit data 'b' of the current frame Fn inputted from the most significant bit bus output line 132 of the timing controller 61 and the most significant bit data 'a' of the previous frame Fn−1 inputted from a most significant bit bus output line 134 of the frame memory 121.

The first comparator 122 receives the most significant bit data 'a' of the previous frame Fn−1 from the most significant output bus line 134 of the frame memory 121. At the same time, it receives the most significant bit data 'b' of the current frame Fn from the most significant bit output bus line 132 of the timing controller 61. The first comparator 122 calculates a value in which the most significant bit data 'b' of the current frame Fn is subtracted from the most significant bit data 'a' of the previous frame Fn−1 and compares the calculated value with '1'. If a value obtained by subtracting the most significant bit data 'b' of the current frame Fn from the most significant bit data 'a' of the previous frame Fn−1 is '1', the first comparator 122 applies high logic '1' to a first input terminal of the first AND gate 126. Otherwise, if a value obtained by subtracting the most significant bit data 'b' of the current frame Fn from the most significant bit data 'a' of the previous frame Fn−1 is not '1', the first comparator 122 applies low logic '0' to the first input terminal of the first AND gate 126.

The second comparator 123 receives the least significant bit data 'c' of the previous frame Fn−1 from the least significant output bus line 133 of the frame memory 121. At the same time, it receives the least significant bit data 'd' of the current frame Fn from the least significant bit output bus line 131 of the timing controller 61. The second comparator 123 calculates a value in which the least significant bit data 'c' of the previous frame Fn−1 is subtracted from the least significant bit data 'd' of the current frame Fn and compares the calculated value with the reference value 'k'. If a value obtained by subtracting the least significant bit data 'c' of the previous frame Fn−1 from the least significant bit data 'd' of the current frame Fn are larger than the reference value 'k', the second comparator 123 applies high logic '1' to a second input terminal of the first AND gate 126. Otherwise, if a value obtained by subtracting the least significant bit data 'c' of the previous frame Fn−1 from the least significant bit data 'd' of the current frame Fn is less than the reference value 'k', the second comparator 123 applies low logic '0' to the second input terminal of the first AND gate 126.

The first AND gate 126 performs a logical operation of two signals inputted from the first and second comparators 122 and 123. If the output signals of the first and second comparators 122 and 123 have high logic '1', that is, if it is determined that current input data are included in the second data area S2 of the look-up table, the first AND gate 126 generates an output signal having high logic '1'. If an output signal of the first comparator 122 has low logic '0', the first AND gate 126 generates an output signal having low logic '0' regardless of a logical value of an output signal of the second comparator 123. On the other hand, if an output signal of the first comparator 122 has high logic '1' and an output signal of the second comparator 123 has low logic '0', that is, if it is determined that the current input data are included in the first data area S1 of the look-up table, the first AND gate 126 generates an output signal having low logic '0'.

The third comparator 124 receives the most significant bit data 'a' of the previous frame Fn−1 from the most significant output bus line 134 of the frame memory 121. At the same time, it receives the most significant bit data 'b' of the current frame Fn from the most significant bit output bus line 132 of the timing controller 61. The third comparator 124 calculates a value in which the most significant bit data 'a' of the previous frame Fn−1 is subtracted from the most significant bit data 'b' of the current frame Fn and compares the calculated value with '1'. If a value obtained by subtracting the most significant bit data 'a' of the previous frame Fn−1 from the most significant bit data 'b' of the current frame Fn is '1', the third comparator 124 applies high logic '1' to a first input terminal of the second AND gate 127. Otherwise, if a value obtained by subtracting the most significant bit data 'a' of the previous frame Fn−1 from the most significant bit data 'b' of the current frame Fn is not '1', the third comparator 124 applies low logic '0' to the first input terminal of the second AND gate 127.

The fourth comparator 125 receives the least significant bit data 'c' of the previous frame Fn−1 from the least significant output bus line 133 of the frame memory 121. At the same time, it receives the least significant bit data 'd' of the current frame Fn from the least significant bit output bus line 131 of the timing controller 61. The fourth comparator 125 calculates a value in which the least significant bit data 'd' of the current frame Fn is subtracted from the least significant bit data 'c' of the previous frame Fn−1 and compares the calculated value with the reference value 'k'. If a value obtained by subtracting the least significant bit data 'd' of the current frame Fn from the least significant bit data 'c' of the previous frame Fn−1 is larger than the reference value 'k', the fourth comparator 125 applies high logic '1' to a second input terminal of the second AND gate 127. Otherwise, if a value obtained by subtracting the least significant bit data 'd' of the current frame Fn from the least significant bit data 'c' of the previous frame Fn−1 is less than the reference value 'k', the fourth comparator 125 applies low logic '0' to the second input terminal of the second AND gate 127.

The second AND gate 127 performs a logical operation of two signals inputted from the third and fourth comparators 124 and 125. If the output signals of the third and fourth comparators 124 and 125 have high logic '1', that is, if it is determined that the current input data are included in the third data area S3 of the look-up table, the second AND gate 127 generates an output signal having high logic '1'. If an output signal of the third comparator 124 has low logic '0', the second AND gate 127 generates an output signal having low logic '0' regardless of a logical value of an output signal of the fourth comparator 125. On the other hand, if an output signal of the third comparator 124 has high logic '1' and an output signal of the fourth comparator 125 has low logic '0', that is, if it is determined that the current input data are included in the fourth data area S4 of the look-up table, the second AND gate 127 generates an output signal having low logic '0'.

The OR gate 128 is connected between the MUX 130 and the first and second AND gates 126 and 127 to perform a logical sum operation of output signals of the first and second AND gates 126 and 127 and control the MUX 130 in accordance with the resultant value. When a logical value of at least one of the output signals of the first and second AND gates 126 and 127 after the logical sum operation is '1', the OR gate 128 outputs high logic '1'. In other words, when the current input data are included in the second data area S2 or the third data area S3 of the look-up table, the OR gate 128 generates an output signal having high logic '1'. On the other hand, if the output signals of the first and second AND gates 126 and 127 have low logic '0', that is, when the current input data are included in the first data area S1 or the fourth data area S4 of the look-up table, the OR gate 128 outputs an output signal having low logic '0'.

The MUX 130 is supplied with the modulated most significant bit data mb modulated by the look-up table 129 and the most significant bit data MSB inputted through the most significant bit output bus line 132 of the timing controller 61, that is, the non-modulated most significant bit data 'b'. The MUX 130 is controlled by an output signal of the OR gate 128 to select one of the modulated most significant bit data mb and the non-modulated most significant bit data 'b'. If an output signal of the OR gate 130 has high logic '1', the MUX 130 outputs the non-modulated most significant bit data 'b'. If an output signal of the OR gate 128 has low logic '0', the MUX 130 outputs the modulated most significant bit data mb modulated by the look-up table 129. Accordingly, when it is determined that the current input data are included in the second and third data areas S2 and S3 of the look-up table, the MUX 130 selects the non-modulated most significant bit data 'b'. On the other hand, when it is determined that the current input data are included in the first and fourth data areas S1 and S4, the MUX 130 selects the modulated most significant bit data mb.

The most significant bit data 'b' or mb selected by using the MUX 130 in this manner is combined with the least significant bit data 'd' bypassed through the least significant bit output bus line 131 of the timing controller 61 to be applied to the data driver 63.

As described above, in the present invention, only the most significant bit data MSB are selected for a modulation in order to reduce the size of the look-up table. Alternatively, although the size of the look-up table is slightly enlarged, both the most significant bit data MSB and the least significant bit data LSB may be selected for a modulation.

As described above, according to the present invention, a data modulation is performed based on a change in each most significant bit data and least significant bit data at the previous frame and the current frame to prevent a deterioration of the picture quality. Furthermore, a judgment as to whether current input data to be modulated is accurately made in the present invention.

Figure 6:
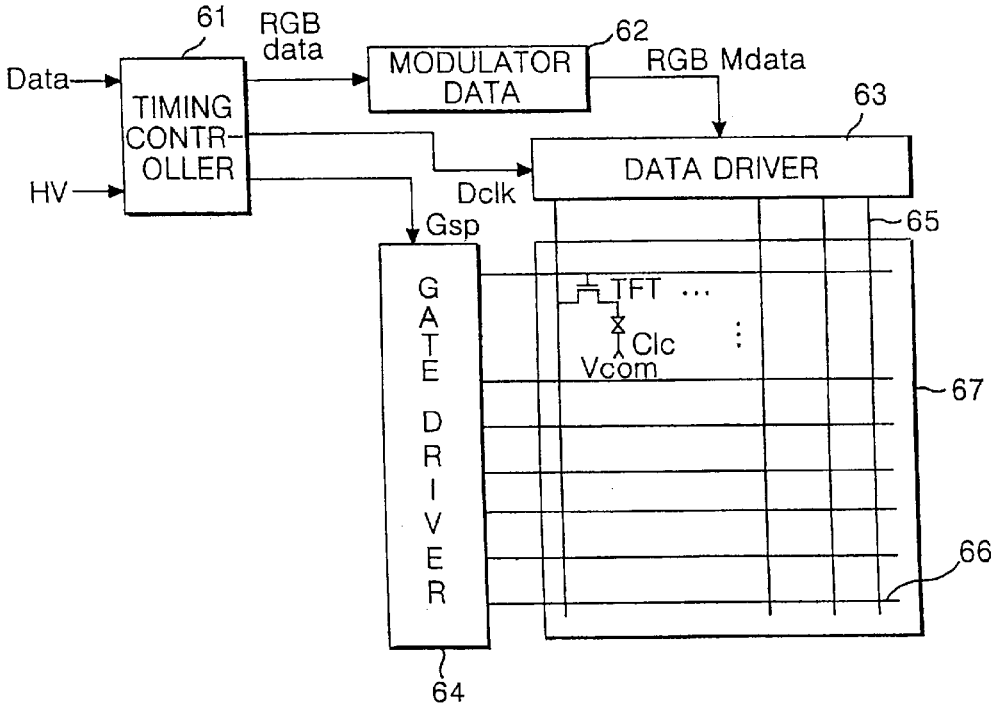
FIG. 6 is a block diagram showing a configuration of an apparatus for driving a liquid crystal display according to the present invention.

The data modulator shown in FIG. 6 may be installed at the earlier stage of the timing controller to modulate the data inputted to the timing controller. Also, the data modulator may be implemented by other means, such as a software and a microprocessor for carrying out this software, rather than a look-up table.

It will be apparent to those skilled in the art that various modifications and variations can be made in the method and apparatus for driving the liquid display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

dividing input data into most significant bit data and least significant bit data;

detecting changes in the most significant bit data and the least significant bit data;

comparing the change in the most significant bit data with a first reference value;

comparing the change in the least significant bit data with a second reference value; and determining whether the input data are modulated in accordance with the compared results.

2. The method according to claim 1, wherein the detecting changes includes:

delaying the most significant bit data and the least significant bit data for a frame period;

calculating a first difference between non-delayed most significant bit data and the delayed most significant bit data; and calculating a second difference between non-delayed least significant bit data and the delayed least significant bit data.

3. A method of driving a liquid crystal display, comprising:

dividing input data from an input line into most significant bit data and least significant bit data;

detecting changes in the number of bits of the most significant bit data and the least significant bit data between current and previous frames;

comparing the change in the number of bits of the most significant bit data with a first reference value;

comparing the change in the least significant bit data with a second reference value;

modulating the input data if the change in the most significant bit data is equal to the first reference value and the change in the least significant bit data is smaller than the second reference value; and supplying the input data without a modulation if the change in the most significant bit data is equal to the first reference value and the change in the least significant bit data is equal to or larger than the second reference value.

4. The method according to claim 3, further comprising:

modulating the input data if the change in the most significant bit data is different from the first reference value.

5. The method according to claim 3, wherein the data modulating the input data includes modulating the most significant bit data.

6. The method according to claim 3, wherein the first reference value is '1'.

7. A method of driving a liquid crystal display, comprising:

dividing input data from an input line into most significant bit data and least significant bit data;

determining whether current most significant bit data are included in a first data area of a look-up table;

comparing a first difference value in the number of bits between current least significant bit data and previous least significant bit data with a first reference value if the current most significant bit data are included in the first data area of the look-up table; determining whether the current most significant bit data are to be modulated in accordance with the compared result of the first difference value;

determining whether the current most significant bit data are included in a second data area of the look-up table; comparing a second difference value in the number of bits between the current input least significant bit data and the previous least significant bit data with a second reference value if the current most significant bit data are included in the second data area of the look-up table; and determining whether the current most significant bit data are to be modulated in accordance with the compared result of the second difference value.

8. The method according to claim 7, wherein the determining whether current most significant bit data are included in a first data area of a look-up table includes, subtracting the current most significant bit data from the previous most significant bit data if the number of bits of the current most significant bit is greater than that of the previous most significant bit data; and determining whether a value obtained by subtracting the current most significant bit data from the previous most significant bit data is '1'.

9. The method according to claim 7, wherein determining whether current most significant bit data are included in a first data area of a look-up table includes, subtracting the previous most significant bit data from the current most significant bit data if the number of bits of the previous most significant bit data is greater than that of the current most significant bit data; and determining whether a value obtained by subtracting the previous most significant bit data from the current most significant bit data is '1'.

10. The method according to claim 7, wherein the current most significant bit data are modulated if a subtracted value between the previous least significant bit data and the current least significant bit data is different from the first reference value.

11. The method according to claim 7, wherein the first reference value is '1'.

12. The method according to claim 7, wherein the second reference value is a minimum recognizable gray level change by an observer.

13. The method according to claim 7, wherein the current most significant bit data are not modulated if a first subtracted value between the previous most significant bit data and the current most significant bit data is the same as the first reference value and if a second subtracted value between the previous least significant bit data and the current least significant bit data is greater than the second reference value.

14. An apparatus for driving a liquid crystal display, comprising:

a frame memory delaying each of most significant bit data and least significant bit data included in input data from an input line;

a first comparator comparing the most significant bit data from the input line with the delayed most significant bit data to obtain a first difference amount in the number of bits in the most significant bit data and comparing the first difference amount with a first reference value;

a second comparator comparing the least significant bit data from the input line with the delayed least significant bit data to obtain a second difference amount in the number of bits in the least significant bit and comparing the second difference amount with a second reference value; and a selector determining whether the most significant bit data from the input line is to be modulated in accordance with the compared results of the first and second comparators.

15. The apparatus according to claim 14, further comprising:

a data driver supplying the modulated data and the input data from the input line to a liquid crystal display;

a gate driver applying a scanning signal to the liquid crystal display; and a timing controller applying the input data to the input line and controlling the data driver and the gate driver.

16. An apparatus for driving a liquid crystal display, comprising:

a frame memory delaying each of most significant bit data and least significant bit data included in input data from an input line;

a first comparator comparing the most significant bit data from the input line with the delayed most significant bit data to obtain a first difference amount in the number of bits in the most significant bit data and comparing the first difference amount with a first reference value;

a second comparator comparing the least significant bit data from the input line with the delayed least significant bit data to obtain a second difference amount in the number of bits in the least significant bit data and comparing the second difference amount with a second reference value;

a modulator modulating the input data; and a selector selecting one of the modulated data and the input data from the input line in accordance with the compared results of the first and second comparators.

17. The apparatus according to claim 16, wherein the second reference value is a minimum recognizable gray level change by an observer.

18. The apparatus according to claim 16, wherein the modulator modulates the most significant bit data using a look-up table.

19. The apparatus according to claim 16, wherein the selector selects the modulated input data if the first difference amount is equal to the first reference value and the second difference amount is smaller than the second reference value.

20. The apparatus according to claim 16, wherein the selector selects the modulated data if the first difference amount is different from the first reference value.

21. The apparatus according to claim 16, where in the selector selects the input data from the input line if the first difference amount is equal to the first reference value and the second difference amount is larger than the second reference value.

22. The apparatus according to claim 16, wherein the selector includes, a gate device performing a logical operation of output signals of the first and second comparators; and a switching device selecting one of an output of the modulator and the input data from the input line in accordance with an output of the gate device.

23. The apparatus according to claim 16, wherein the first reference value is '1'.

24. The apparatus according to claim 16, further comprising:

a data driver supplying the modulated data and the input data from the input line to a liquid crystal display;

a gate driver applying a scanning signal to the liquid crystal display; and a timing controller applying the input data to the input line and controlling the data driver and the gate driver.

25. An apparatus for driving a liquid crystal display, comprising:

a frame memory delaying each of most significant bit data and least significant bit data included in input data from an input line;

a first comparator subtracting the most significant bit data from the input line from the delayed most significant bit data and comparing the subtracted value with a first reference value;

a second comparator subtracting the delayed least significant bit data from the least significant bit data from the input line and comparing the subtracted value with a second reference value;

a first logic device determining whether the most significant bit data inputted from the input line are modulated in accordance with the compared results of the first and second comparators;

a third comparator subtracting the delayed most significant bit data from the most significant bit data of the input line and comparing the subtracted value with the first reference value;

a fourth comparator subtracting the least significant bit data from the input line from the delayed least significant bit data and comparing the subtracted value with the second reference value;

a second logic device determining whether the most significant bit data inputted from the input line is modulated in accordance with the compared results of the third and fourth comparators;

a modulator modulating the most significant bit data from the input line in accordance with a change between the most significant bit data inputted from the input line and the delayed most significant bit data; and a selector selecting one of the modulating data and the input data from the input line in accordance with output logical values of the first and second logic devices.

26. The driving apparatus according to claim 25, where each of the first and second logic devices is an AND gate.

27. The driving apparatus according to claim 25, wherein the selector includes, an OR gate performing a logical sum operation of the output signals of the first and second logic devices; and a switching device selecting one of an output of the modulator and the input data from the input line under control of the OR gate.

* * * * *